US006945603B2

(12) United States Patent
Elzenbeck

(10) Patent No.: US 6,945,603 B2
(45) Date of Patent: Sep. 20, 2005

(54) CHAIR, IN PARTICULAR OFFICE CHAIR

(75) Inventor: Manfred Elzenbeck, Steinheim/Murr (DE)

(73) Assignee: Dauphin Entwicklungs-u. Beteiligungs GmbH, Hersbruck (DE)

( * ) Notice: Subject to any disclaimer, the term of this patent is extended or adjusted under 35 U.S.C. 154(b) by 0 days.

(21) Appl. No.: 10/792,772

(22) Filed: Mar. 5, 2004

(65) Prior Publication Data

US 2004/0174057 A1 Sep. 9, 2004

(30) Foreign Application Priority Data

Mar. 7, 2003 (DE) ..... 103 09 921

(51) Int. Cl.[7] ..... A47C 1/032

(52) U.S. Cl. ..... 297/303.4; 297/300.5; 297/303.5

(58) Field of Search ..... 297/300.5, 301.4, 297/302.4, 303.1, 303.5, 303.4

(56) References Cited

U.S. PATENT DOCUMENTS

| | | | | |
|---|---|---|---|---|
| 3,656,593 A | | 4/1972 | Bauer | |
| 4,652,050 A | * | 3/1987 | Stevens | 297/303.4 |
| 4,653,806 A | * | 3/1987 | Willi | 297/300.5 |
| 4,709,963 A | * | 12/1987 | Uecker et al. | 297/300.5 |
| 5,192,114 A | * | 3/1993 | Hollington et al. | 297/300.5 |
| 5,328,237 A | * | 7/1994 | Yamaguchi et al. | 297/303.4 |
| 5,397,165 A | * | 3/1995 | Grin et al. | 297/300.5 |
| 5,797,653 A | * | 8/1998 | Elzenbeck et al. | 297/300.5 |
| 6,607,244 B2 | * | 8/2003 | Stulik et al. | 297/302.4 |
| 6,712,428 B2 | * | 3/2004 | Moreschi | 297/303.4 |
| 6,758,523 B2 | * | 7/2004 | VanDeRiet et al. | 297/300.5 |

FOREIGN PATENT DOCUMENTS

| | | |
|---|---|---|
| DE | 4324543 | 1/1995 |
| DE | 4324545 | 1/1995 |
| EP | 0839478 | 5/1998 |

* cited by examiner

*Primary Examiner*—Peter R. Brown
(74) *Attorney, Agent, or Firm*—Browdy and Neimark, PLLC

(57) ABSTRACT

A chair comprises a seat support with a front seat support part and a rear seat support part which is connected thereto via a pivoting axis. An adjustable length energy storing device serves for adjustment relative to each other of the seat support parts. The energy storing device is pivotably supported on the seat support parts at a distance from the pivoting axis. This distance can be modified by means of an adjusting element by operation of a turning handle. The turning handle is connected to the adjusting element via a coupling element, with the axes of rotation of the adjusting element and turning handle not being in alignment. This ensures conveniently accessible modification of the adjusting force of the energy storing device.

5 Claims, 11 Drawing Sheets

CHAIR, IN PARTICULAR OFFICE CHAIR

BACKGROUND OF THE INVENTION

1. Field of the Invention

The invention relates to an chair, in particular an office chair, comprising a pedestal; a seat support which supports itself thereon by a chair column, the seat support comprising a front seat support part and a rear seat support part which is pivotably connected thereto via a substantially horizontal pivoting axis, a seat which supports itself on the seat support parts; a backrest which is fixed to the rear seat support part; an adjustable length energy storing device for adjustment relative to each other of the backrest and seat, a first end of the energy storing device being pivotably mounted on the front seat support part by an abutment and the second end of which being pivotably supported on the rear seat support part at a distance from the pivoting axis; an adjusting element for modification of the distance, which is rotatable about an adjusting-element axis of rotation; and a turning handle for operation of the adjusting element, the turning handle being connected to the adjusting element and rotatable about a turning-handle axis of rotation.

2. Background Art

A chair of the generic type is known from DE 43 24 545 A1. This known design is a so-called synchronous mechanism in which the backrest and seat are simultaneously pivoted in a certain given relation. An energy storing device in the form of a helical compression spring is disposed between the front seat member and the rear seat member, serving to produce a force that acts between the front seat support part and the rear seat support part, forcing the backrest into its forward limit position and the rear portion of the seat into its upper position. A so-called rocker mechanism additionally offers the possibility that a user may move his back against the restoring force of the energy storing device. The restoring force of the energy storing device can be regulated by means of an adjusting screw from below the front seat support part by modification of the distance of the energy-storing-device support from the pivoting axis. For modification of the restoring force, the user of the chair must stand up and operate the turning handle.

SUMMARY OF THE INVENTION

It is an object of the invention to improve a chair of the generic type in such a way that regulating the restoring force of the energy storing device is easily feasible.

According to the invention, this object is attained by the features wherein the turning handle is connected to the adjusting element via a coupling element for translation of the operating motion of rotation into an adjusting motion; with the adjusting-element axis of rotation and the turning-handle axis of rotation not being in alignment.

The gist of the invention resides in providing, between the adjusting element and the turning handle, a coupling element which permits a turning moment to be transmitted from the turning handle to the adjusting element, there being no need for the axis of rotation of the adjusting element to align with that of the turning handle. This provides for greater freedom of design of the turning handle so that it becomes more freely accessible for a user, in particular when the user is sitting. The coupling element can be embodied in such a way that the adjusting-element systems of existing chair constructions can be completed in a constructionally simple way.

Coupling elements comprising a deviating gear, with the deviating gear being a bevel gear pair which is in particular spur toothed, also permit safe transmission of comparatively high transmission forces.

Given an embodiment of the coupling element according to which a conical gear wheel of the bevel gear pair has an internal thread with which engages an external gear, complementary thereof, of another coupling component of the coupling element, in particular of the adjusting element, mechanical components of known chair constructions can be adopted virtually without modification.

A turning handle that is laterally extended out of the seat support part is easily accessible even when the user is sitting.

An adjusting element in the form of an adjusting screw is not complicated constructionally.

Details of the invention will become apparent from the ensuing description of an exemplary embodiment of the invention, taken in conjunction with the drawing.

DESCRIPTION OF A PREFERRED EMBODIMENT

Figure 1:
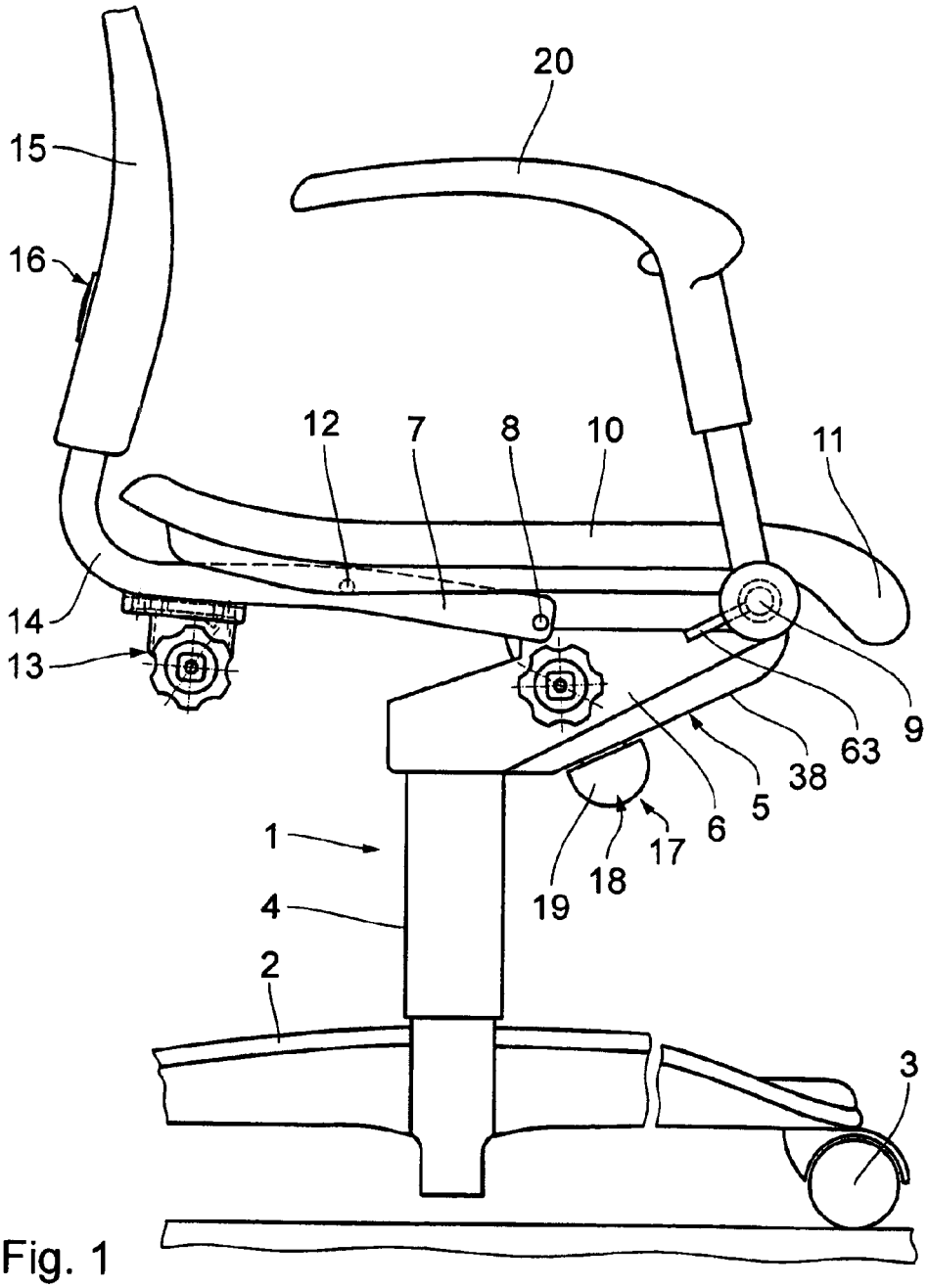
FIG. 1 is a perspective view of an entire chair.

FIG. 1 illustrates an office chair with a chair stand 1. The chair stand 1 comprises a pedestal 2 which supports itself via castors 3 on the ground. An adjustable height chair column 4 is mounted on the pedestal 2; a seat support 5 is fixed to the upper end of the column 4. The seat support 5 is of two-piece design; it comprises a front seat support part 6 mounted on the chair column 4 and a rear seat support part 7 which, above the chair column 4, is articulated to the front seat support part 6 by means of a hinge that is rotatable about a pivoting axis 8. A stay pipe 9 which is parallel to the pivoting axis 8 is secured in the front area of the front seat support part 6. A seat 10 supports itself on this stay pipe 9 shortly behind its front edge 11. The stay pipe 9 constitutes a front support section for the seat 10. The seat 10 supports itself by its rear area on a supporting axis 12 which is lodged in the rear seat support part 7. The supporting axis 12 is a rear support section for the seat 10. A seat inclination adjusting device 13 is disposed on the rear seat support part 7.

A backrest support 14 with a backrest 15 mounted thereon projects upwards from the rear seat support part 7 on which it is integrally formed. A backrest height adjusting device 16 is provided for height adjustment of the backrest 15 relative to the seat 10.

The described design of the seat support 5, comprising the arrangement of the seat 10 and the backrest 15, constitutes a so-called synchronous mechanism. For modification for the forces that must be overcome by a user upon adjustment or during rocking, provision is made for a force variation equipment which is designated in its entirety by 17 and will be explained in detail below. An adjusting nut 18, which stands out downwards from the front seat support part 6, is part of the force variation equipment 17; FIG. 1 illustrates a freely rotatable cap 19 of this adjusting nut 18.

Armrests 20 are arranged on the outer ends of the stay pipe 9 in vicinity to the front edge 11 of the seat 10. Only one armrest 20 is visible in the lateral view of FIG. 1.

Figure 3:
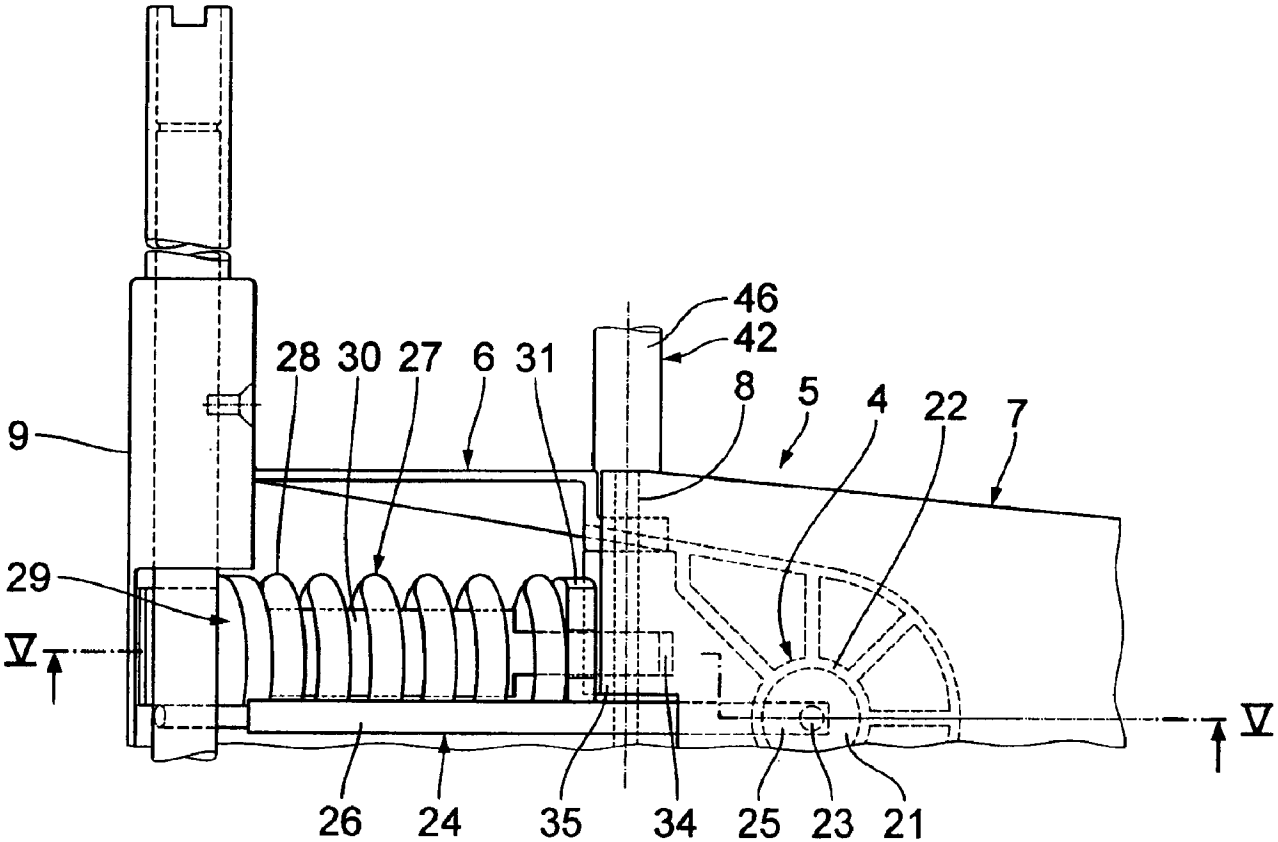
FIG. 3 is an interrupted plan view, not sectional, of the seat support similar to FIG. 2.
Figure 4:
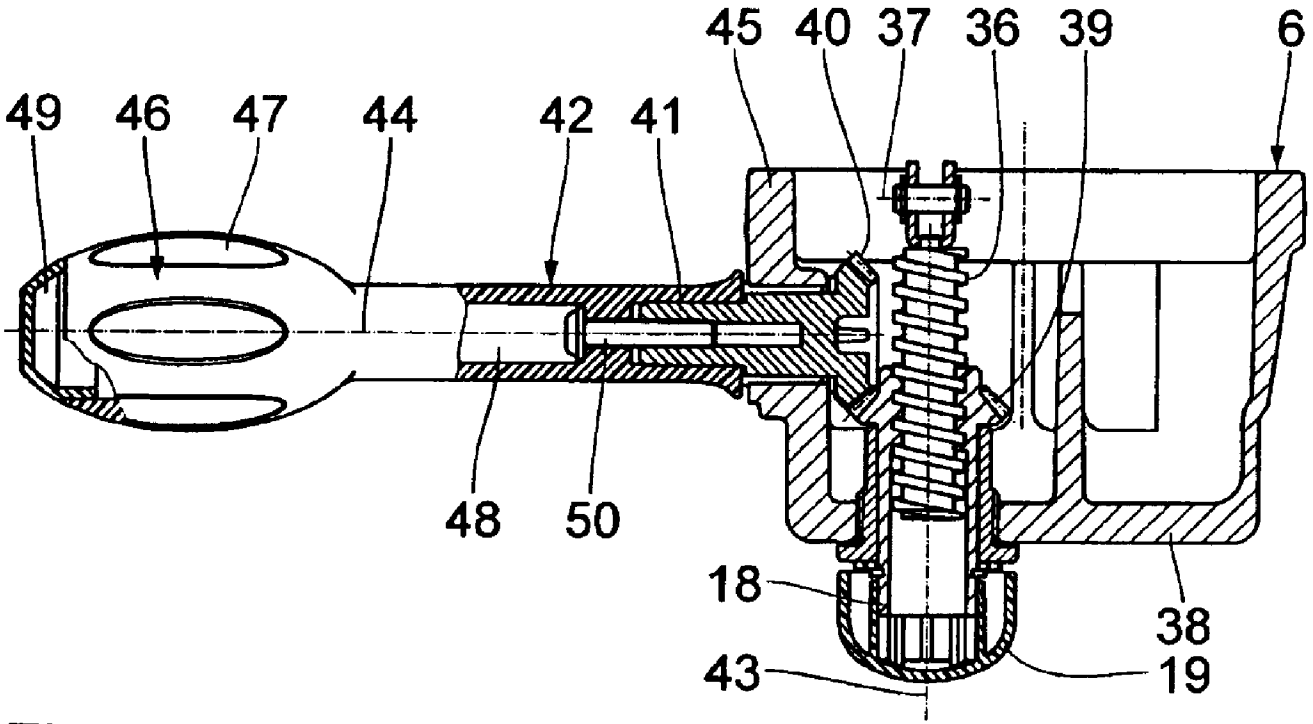
FIG. 4 is a sectional view on the line IV—IV of FIG. 2.

For height adjustment of the seat support 5, together with the seat 10 and the backrest 15, the chair column 4 comprises a known adjustable length gas spring 21, which is seen in a plan view in FIG. 3. The gas spring 21 is clamped in a clamping device 22, in the form of a cone, of the front seat support part 6. A valve control pin 23 projects upwards from the gas spring 21; when it is pushed into the gas spring 21, this will open a valve that is located there, enabling the gas spring 21 to be adjusted in length. Gas springs of the generic type are illustrated and described for example in U.S. Pat. No. 3,656,593. For actuation of the valve control pin 23, provision is made for a two-arm valve control lever 24 which supports itself pivotably on the pivoting axis 8, as specified for example in DE 43 24 545 A1. A first lever arm 25 of the valve control lever 24 bears against the valve control pin 23, whereas the second lever arm 26 can be operated by a lever mechanism known from DE 43 24 545 A1.

Figure 2:
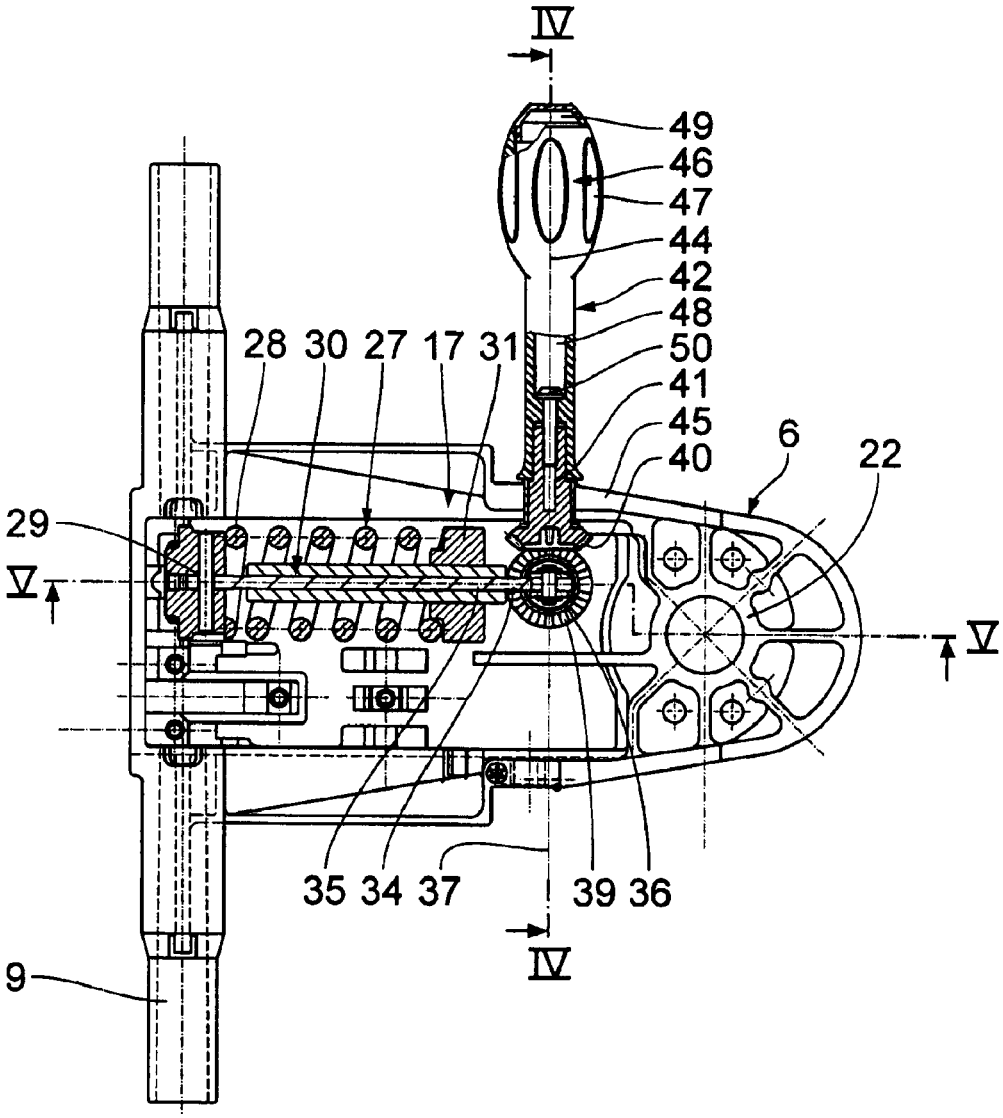
FIG. 2 is a plan view, partially sectional, of a seat support of the chair according to FIG. 1.

Any pivoting of the rear seat support part 7 relative to the front seat support part 6 is counteracted by an energy storing device 27 which is a pre-loaded helical compression spring 28 in the exemplary embodiment shown. The spring 28, by way of a pivoting abutment 29 seen in particular in FIGS. 2 and 5, supports itself on the front seat support part 6 in an area in vicinity to the front edge 11 of the seat 10. To this end, the energy storing device 27 comprises a guide rod 30 which passes through the helical compression spring 28. By its other end, the helical compression spring 28 supports itself on a guide shoe 31 of the force variation equipment 17. The guide shoe 31 bears against a slide face 32 formed on a first short lever arm 33 of the rear seat support part 7. The lever arm 33 is integral with the rear seat support part 7, extending from the pivoting axis 8 substantially downwards. In this regard, the rear seat support part 7 has the geometry of an elbow lever. The guide shoe 31 is displaceable on the guide rod 30 along the helical compression spring 28. The force variation equipment 17 acts on an adjusting section 34, opposite the abutment 29, of the guide rod 30. A connecting section 35, adjoining the adjusting section 34, of the guide rod 30 passes through the first lever arm 33 of the rear seat support part 7. Opposite the section of the guide rod 30 that passes through the helical compression spring 28, the connecting section 35 is elbowed in a direction towards the rear seat support part 7. The adjusting section 34 of the guide rod 30 is therefore crimped towards the rear seat support part 7 and arranged in vicinity to the seat support 5.

An adjusting screw 36 is part of the force variation equipment 17; it is pivotably articulated to the adjusting section 34 of the guide rod 30 by way of a hinge with a pivoting axis 37.

Figure 5:
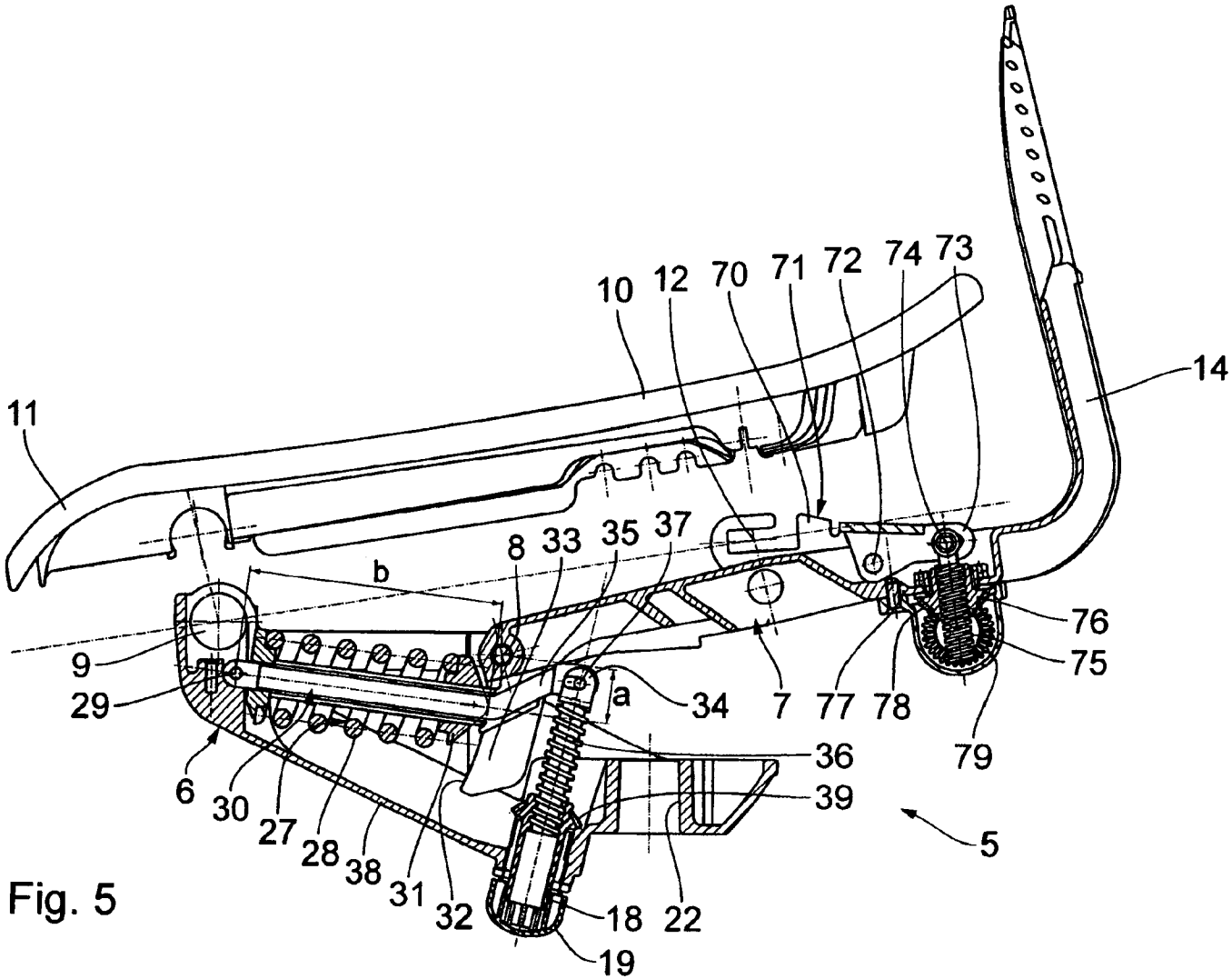
FIG. 5 is a sectional view on the line V—V of FIG. 2 with an adjusting screw in a position screwed further out as compared to FIG. 4.

The distance between the pivoting axis 8 and the seat support parts 6, 7 on the one hand and the central axis of the helical compression spring 28 on the other is designated by a in FIG. 5.

The adjusting screw 36 engages with the adjusting nut 18 which is lodged in a bottom wall 38 of the front seat support part 6 rotatably, but non-displaceably in the direction of the adjusting screw 36. At the end opposite the cap 19, the adjusting nut 18 is provided with a spur toothed conical section 39. An equally spur toothed conical section 40 of an end portion 41 of a turning handle 42 engages with the gear ring of the spur toothed conical section 39, the two conical sections 39, 40 forming a spur toothed bevel gear pair. An axis of rotation 43 of the adjusting screw 36 and an axis of rotation 44 of the turning handle 42 are not in alignment, but intersect, together making a right angle. The end portion 41 is lodged in a side wall 45 of the front seat support part 6 for rotation, but not for displacement axially of the axis of rotation 44 of the turning handle 42.

The free end of the turning 42 is an oval handle 46 with recessed grips 47. The handle 46 has a central drilled hole 48 which is closed at the free end of the handle 46 by a cap 49 which is placed on. A connecting bolt 50 is inserted into the drilled hole, securing the handle 46 to the end portion 41 of the turning handle 42.

Upon rotation of the turning handle 42, this rotation is translated, via the interengaging conical sections 39, 40, into an axial adjusting motion of the adjusting screw 36 along the axis of rotation 43. Therefore, the conical sections 39, 40 constitute a coupling element, by way of which the turning handle 42 is connected to the adjusting screw 36 as an adjusting element. Upon rotation of the turning handle 42, the guide rod 30 is pivoted about the hinge of the abutment 29 by way of the hinge with the pivoting axis 37. In doing so, the guide shoe 31 is displaced on the slide face 32 of the first lever arm 33, this modifying the distance a of the axis of the energy storing device 27 from the pivoting axis 8. Since the slide face 32 lies at least approximately on a segment of an arc of a circle, the center of which is above the axis of the hinge of the abutment 29, a distance b between the pivoting axis of the abutment 29 and the intersection of the axis of the energy storing device 27 by the slide face 32 changes only slightly upon rotation of the turning handle 42. Therefore these adjustments virtually do not change the preload of the helical compression spring 28. Bringing the slide face 32 slightly out of center in relation to the hinge formed by the abutment 29, as described above, helps put into practice that a tensile force, transmitted by the helical compression spring 28, always acts on the adjusting screw 36. As a result, the adjusting screw 36 is always definitely guided in the adjusting nut 18 such that the flanks of the thread of the adjusting screw 36, which lie on top in FIG. 5, rest on the corresponding flanks of the internal thread of the adjusting nut 18.

The force by which the helical compression spring 28 acts on the first lever arm 33 of the rear seat support part 7 is not changed; only the active lever arm i.e., the turning moment by which the helical compression spring 28 acts on the rear seat support part 7 and thus on the seat 10 and the backrest 15, is changed by modification of the distance a between the axis of the energy storing device 27 and the pivoting axis 8. This turning moment is the smaller the smaller the distance a and vice versa. The adjusting forces which are to be applied to the turning handle 42 throughout the adjusting travel of the guide shoe 31 can be kept constant, frictional forces between the guide shoe 31 and the slide face 32 and also the operating forces of the mechanical coupling between the guide rod 30 and the turning handle 42 virtually not changing.

Figure 6:
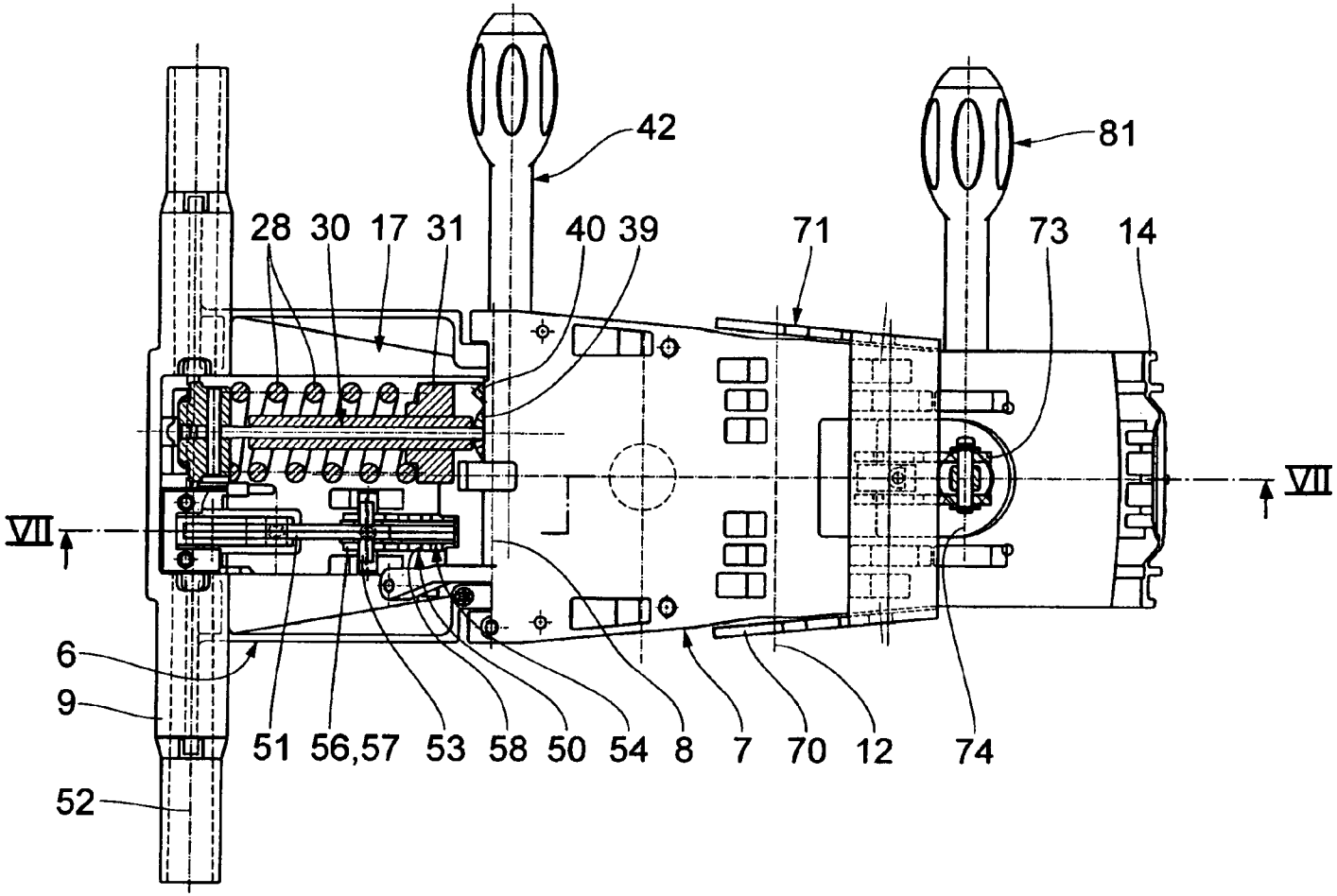
FIG. 6 is a plan view, similar to FIG. 3, of the seat support, showing another portion thereof.
Figure 7:
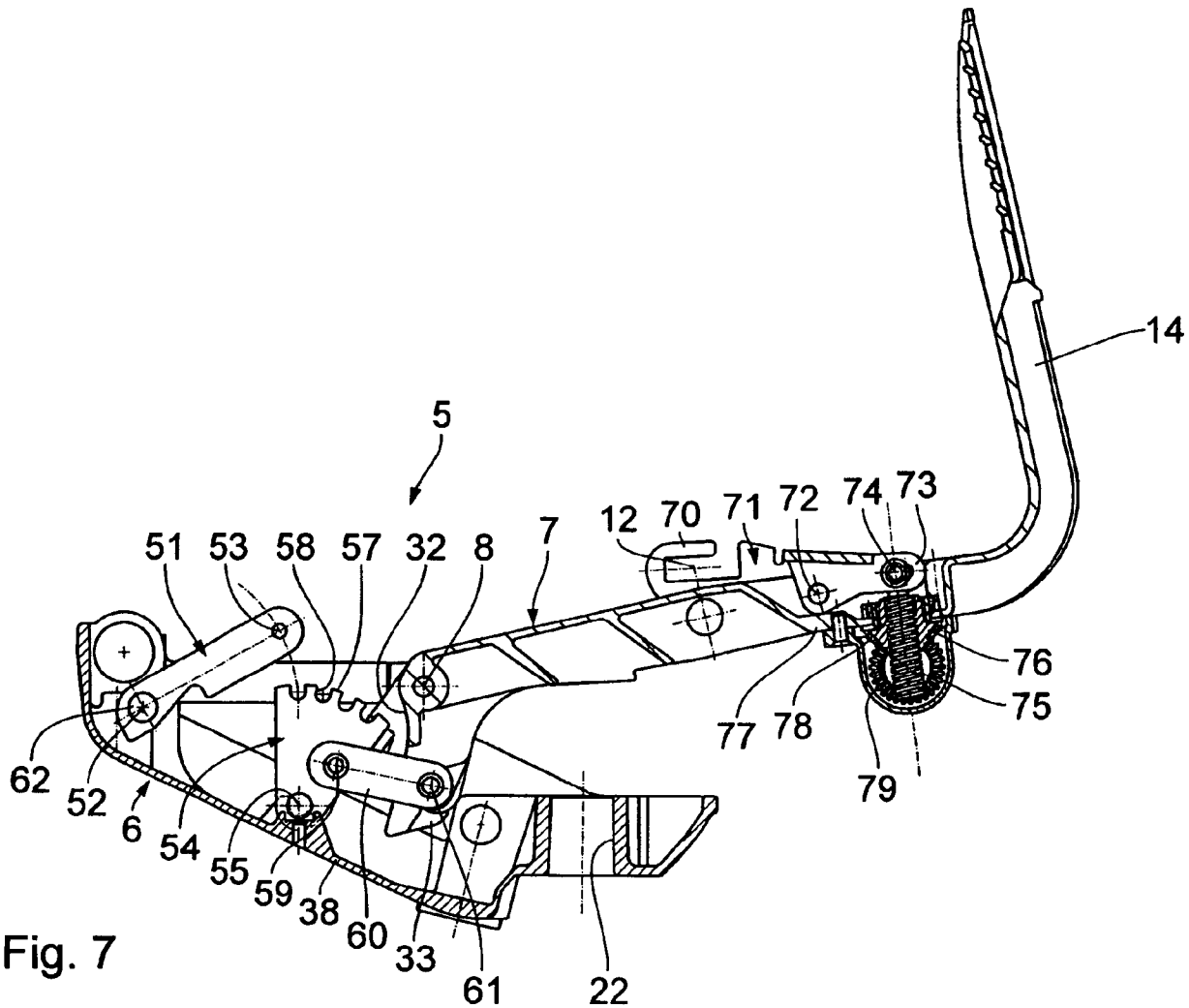
FIG. 7 is a sectional view on the line VII—VII of FIG. 6.
Figure 8:
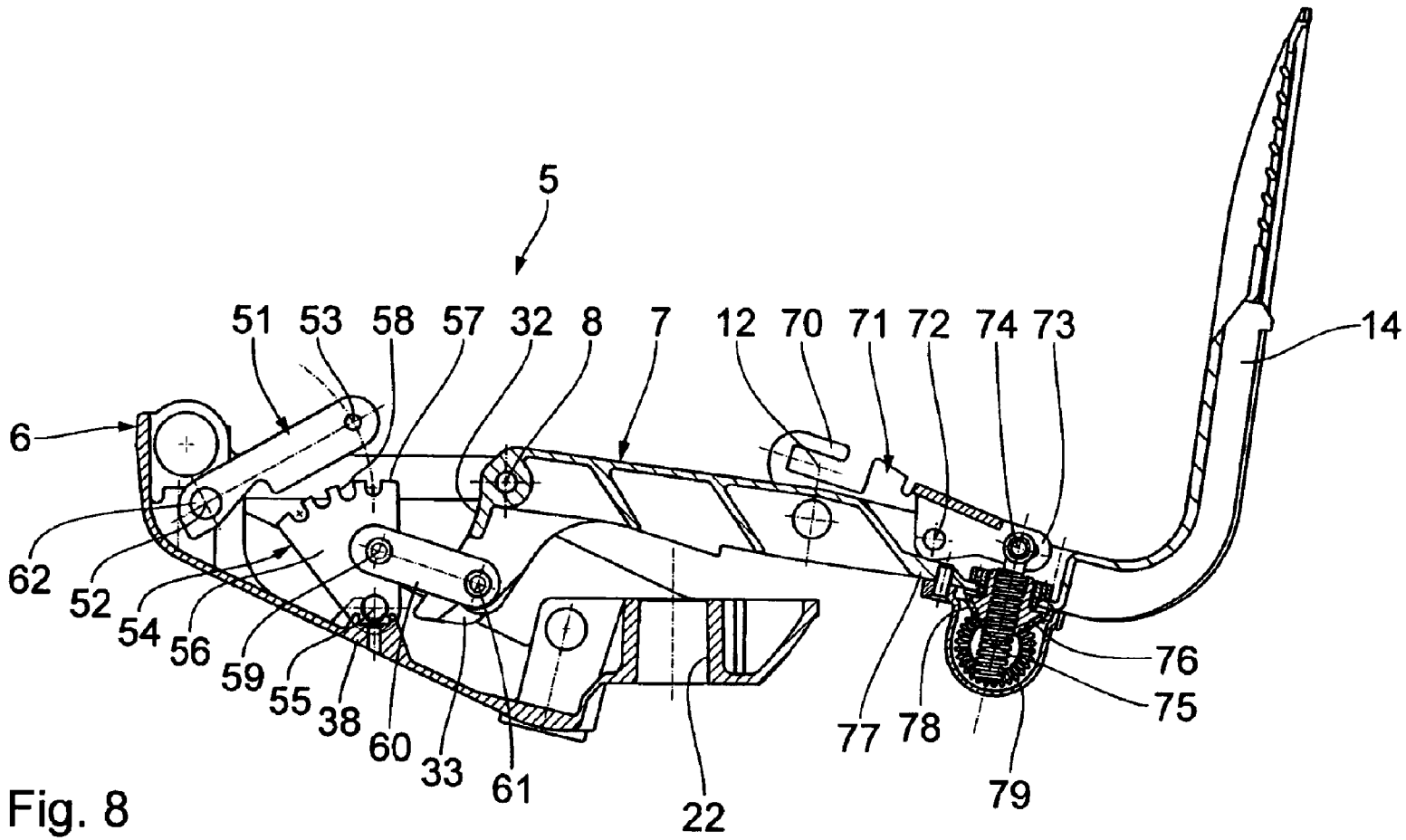
FIG. 8 is a sectional view, similar to FIG. 7, showing another position of two chair seat support parts relative to each other.
Figure 9:
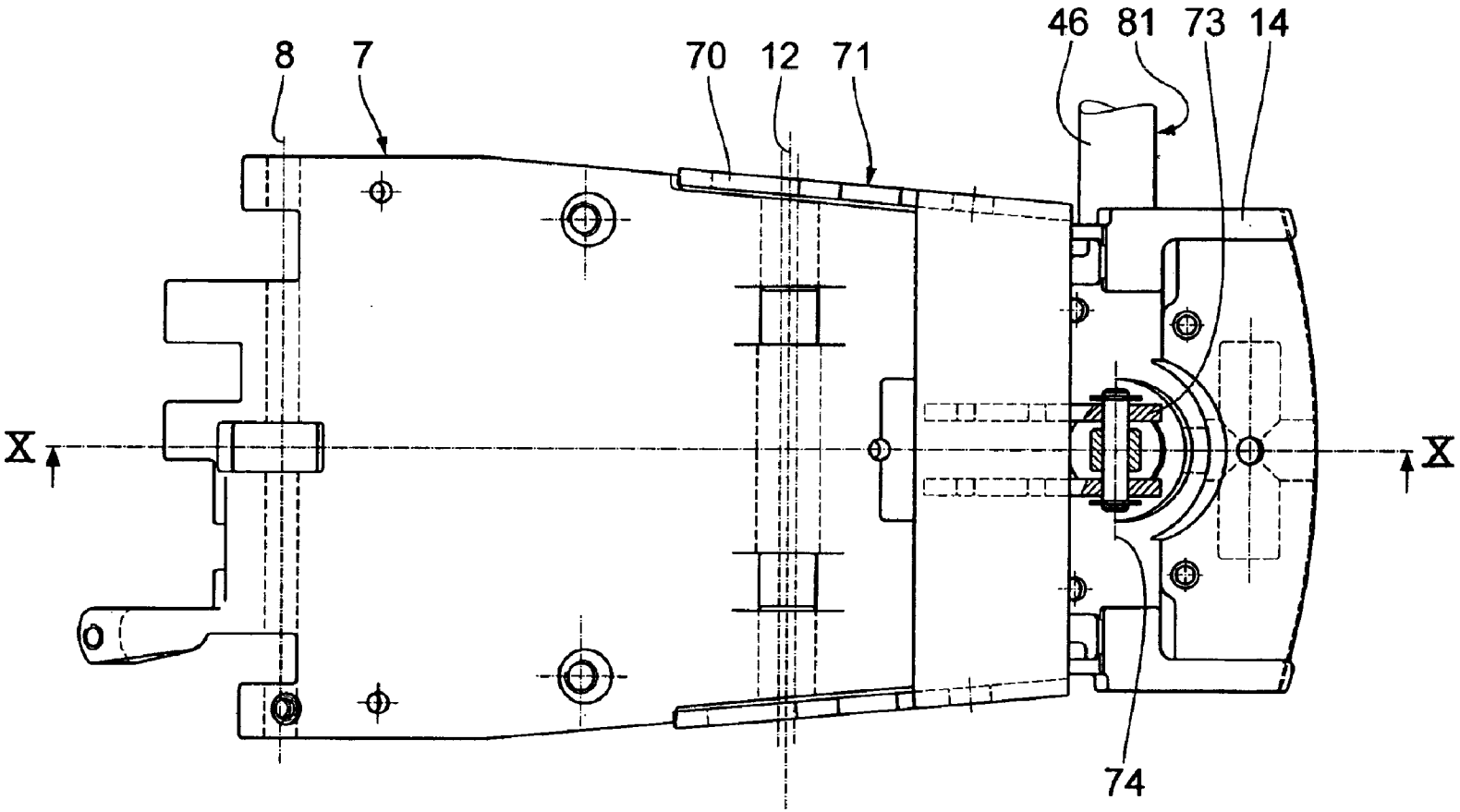
FIG. 9 is a plan view, similar to FIG. 2, of a seat support of an alternative chair.
Figure 10:
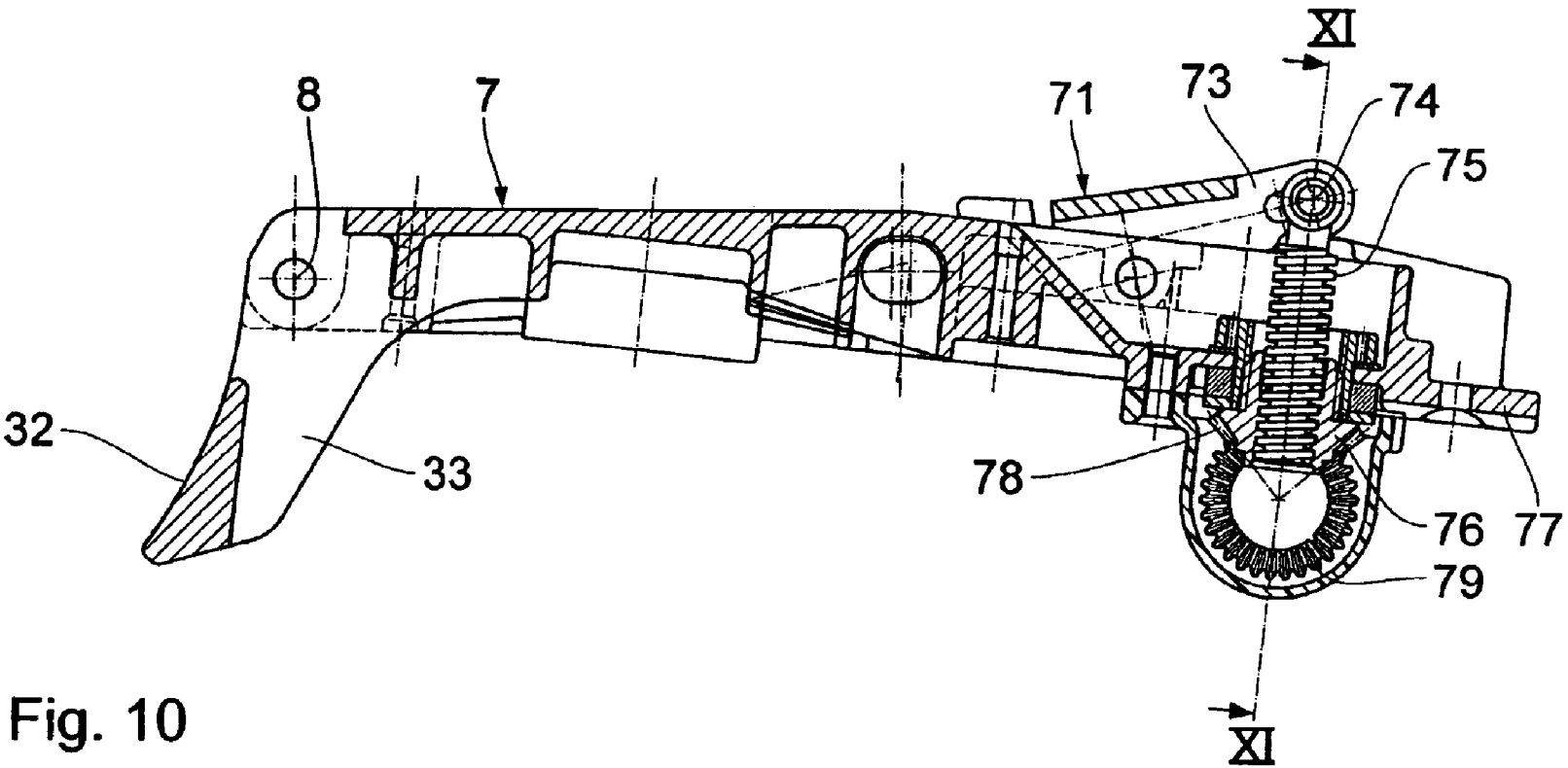
FIG. 10 is a sectional view on the line X—X of FIG. 9.
Figure 11:
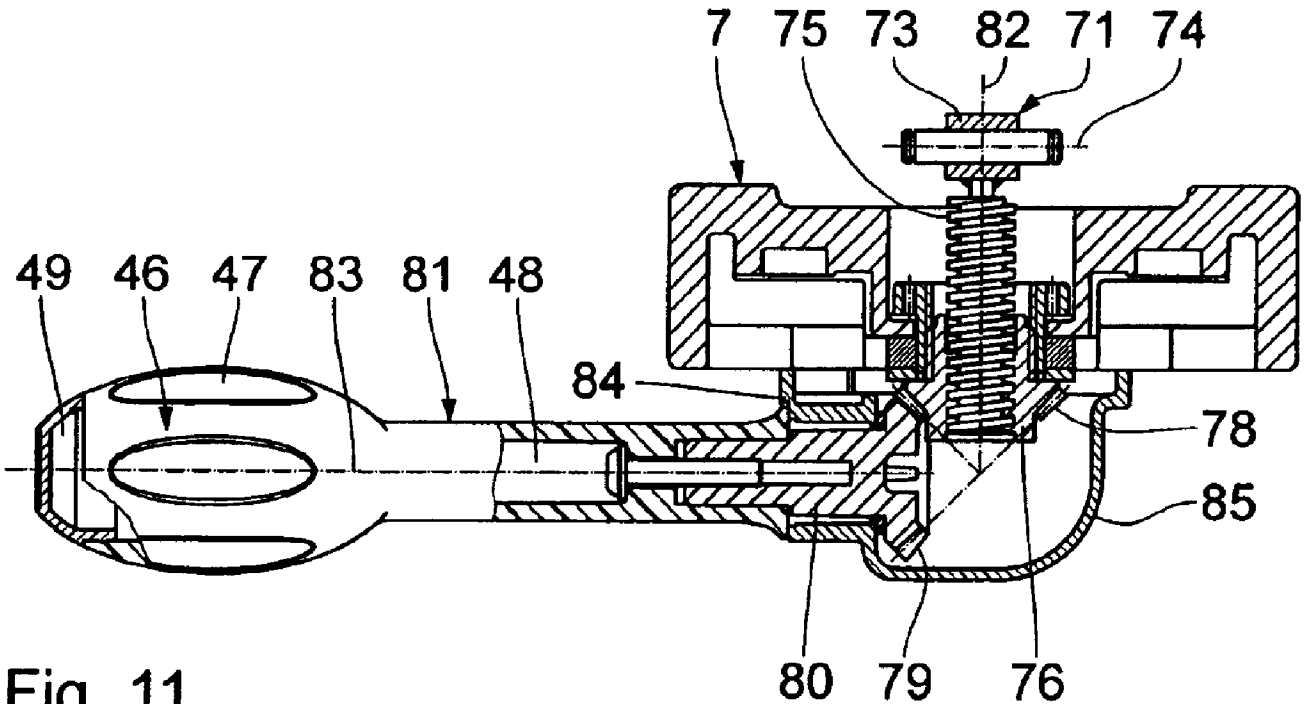
FIG. 11 is a sectional view on the line XI—XI of FIG. 10.

For the joint pivotability of the seat 10 and the backrest 15 in the synchronous mechanism to be inactivated against the power of the helical compression spring 28, provision is made for an interlocking mechanism 50 seen in FIGS. 6 to 8. The interlocking mechanism 50 comprises a lock 51 which is articulated to the front seat support part 6 pivotably about a hinge with a pivoting axis 52. The pivoting axis 52 substantially coincides with the pivoting axis of the abutment 29. The free end, turned away from the pivoting axis 52, of the lock 51 is provided with a horizontal bolt 53 which is fixed to the lock 51, passing there-through such that it projects horizontally from the lock 51 on both sides.

A counterpart body 54 which cooperates with the lock 51 is part of the interlocking mechanism 50. The counterpart body 54 is articulated to the front seat support part 6 pivotably about a hinge with the pivoting axis 55. The pivoting axes 52, 55 are spaced apart and parallel. The counterpart body 54 comprises two parallel and vertical plates 56 which are spaced apart and perpendicular to the pivoting axis 55. They have a triangular configuration by rough approximation and the side opposite the pivoting axis 55 lies approximately on a segment of an arc of a circle, working as a circumferential locking section 57; the pivoting axis 55 is the center of this segment of an arc of a circle.

The circumferential locking section 57 of the plates 56 is provided with four substantially semi-circular locking receptacles 58, two locking receptacles of each plate 56 aligning in pairs. The width of the locking receptacles 58 is complementary of the bolt 53 of the lock 51 and dimensioned such that the bolt 53 can engage, substantially free from play, with a pair of locking receptacles 58 so that one of the two free ends of the bolt 53 engages with one of the two locking receptacles 58 of the corresponding pair of locking receptacles 58.

Via a hinge with a pivoting axis 59, a link 60 is articulated as a coupling element to the counterpart body 54. The pivoting axes 55 and 59 are spaced apart and parallel. Via another hinge with a pivoting axis 61, the link 60 is articulated to the first short lever arm 33 of the rear seat support part 7. The pivoting axis 61 is parallel to, and spaced from, the pivoting axes 8 and 59.

By way of a coupling bolt 62, which is fixed to the front seat support part 6 by means of a support, the lock 51 can be operated by an operating handle 63 which extends laterally out of the stay pipe 9, as seen in FIG. 1.

FIG. 7 illustrates the interlocking mechanism 50 in a position in which the bolt 53 is allocated to the locking receptacle 58 on the far left in the lateral view of FIGS. 7 and 8. In this position, the rear seat support part 7 and the backrest support 14 are in the most upright position.

FIG. 8 illustrates the interlocking mechanism 50 in a position in which the bolt 53 is allocated to the locking receptacle 58 on the far right in FIGS. 7 and 8. In this position, the rear seat support part 7 and the backrest support 14 are inclined farthest backwards into a lying position.

As the distance between the pivoting axes 8 and 61 exceeds the distance between the pivoting axes 55 and 59, pivoting the rear seat support part 7 about the pivoting axis 8 leads to the counterpart body 54 being further pivoted about the pivoting axis 55 as compared to the distance ratio. The link 60 therefore works as a mechanical transmission member, transmitting the pivoting of the counterpart body 54 in relation to the pivoting of the rear seat support part 7.

Normally the interlocking mechanism 50 is out of function so that synchronous motion of the seat support parts 6, 7 relative to each other is possible. When the user puts the synchronous mechanism out of work, i.e. when he wants to interlock the seat support parts 6, 7, he will first move the rear seat support part 7 into a desired position relative to the front seat support part 6 by corresponding pressure on the backrest 15 and thus on the rear seat support part 7 via the backrest support 14. Afterwards the user actuates the operating handle 63, moving the bolt 53 in a direction towards the circumferential locking section 57. Then the bolt 53 either immediately engages with the locking receptacle 58 that adjoins it or the user proceeds with finely adjusting the seat support parts 6, 7 relative to each other by corresponding pressure on the backrest 15 until the bolt 53 engages with the corresponding pair of locking receptacles 58. Once this is done, the synchronous mechanism is interlocked in the desired position of the seat support parts 6, 7 relative to each other. By its transmission function, the link 60 ensures finely graduated, discrete positions of the seat support members 6, 7 relative to each other in spite of the fact that there is not too small a distance from each other of the locking receptacles 58 in the circumferential direction of the circumferential locking section 57.

FIGS. 5 to 8 as well as 10 and 11 illustrate details of the seat inclination adjusting device 13. For seat inclination adjustment, it is possible to vary the height of the supporting axis 12 on which the rear portion of the seat supports itself. To this end, the supporting axis 12 is supported by a first lever arm 70 of an inclination adjusting lever 71 which is pivotable about a pivoting axis 72 that is parallel to the pivoting axis 8. An inclination adjusting screw 75 is articulated to a second lever arm 73 by way of a hinge with a pivoting axis 74 that is equally parallel to the pivoting axis 8. The inclination adjusting screw 75 is mounted axially displaceably and non-rotatably. It engages with an inclination adjusting nut 76 which is lodged in a bottom wall 77 of the rear seat support part 7 rotatably, but non-displaceably in the direction of the inclination adjusting screw 75. At the end opposite the pivoting axis 74, the inclination adjusting nut 76 has a spur toothed conical section 78 with the gear ring of which engages an equally spur toothed conical section 79 of an end portion 80 of an inclination turning handle 81. The two conical sections 78, 79 constitute a spur-toothed bevel gear pair. An axis of rotation 82 of the adjusting screw 75 and an axis of rotation 83 of the inclination turning handle 81 do not align, but intersect, making a right angle. The axes of rotation 44 and 83 of the turning handles 42 and 81 are parallel; the handles 42 and 81 stand out on the same side of the seat support 5. The end portion 80 is lodged in a side wall 84 of a casing 85 for rotation, but against displacement axially of the axis of rotation 83 of the inclination turning handle 81; the casing 85 is fixed to the rear seat support part 7.

The free end of the turning handle 81, as that of the turning handle 42, is an oval handle 46 so that, in this regard, reference can be made to the description of the turning handle 42.

Any rotation of the inclination turning handle 81 is translated by the interengaging conical sections 78, 79 into an axial adjusting motion of the adjusting screw 75 along the axis of rotation 82. The conical sections 78, 79 therefore constitute a coupling element by way of which the inclination turning handle 81 is connected to the adjusting screw 75 as an adjusting element. Upon rotation of the inclination turning handle 81, the inclination adjusting lever 71 is pivoted about the pivoting axis 72 via the hinge with the pivoting axis 74. This serves to adjust the height of the supporting axis 12 above the ground and thus the inclination of the seat 10. The higher the supporting axis 12 is set, the more the seat 10 inclines downwards in the direction towards its front edge 11.

In another embodiment (not shown), mechanical coupling of the motions of rotation of the turning handle 42 about the axis of rotation 44 on the one hand and of the adjusting screw 36 about the axis of rotation 43 on the other hand is effected by a flexible shaft, in particular a spring shaft, instead of a bevel gear pair. Flexible power transmission shafts of this type are known. Such a flexible shaft also serves to enable mechanical coupling to take place of the motions of rotation of the inclination turning handle 81 about the axis of rotation 83 on the one hand and of the adjusting screw 75 about the axis of rotation 82 on the other hand.

What is claimed is:

1. A chair, in particular office chair, comprising a pedestal (2);

a seat support (5) which supports itself thereon by a chair column (4), the seat support (5) comprising a front seat support part (6) and a rear seat support part (7) which is pivotably connected thereto via a substantially horizontal pivoting axis (8), a seat (10) which supports itself on the seat support parts (6, 7);

a backrest (15) which is fixed to the rear seat support part (7);

an adjustable length energy storing device (27) for adjustment relative to each other of the backrest (15) and seat (10), a first end of the energy storing device (27) being pivotably mounted on the front seat support part (6) by an abutment (29) and the second end of which being pivotably supported on the rear seat support part (7) at a distance (a) from the pivoting axis (8);

an adjusting element (36) for modification of the distance (a), which is rotatable about an adjusting-element axis of rotation (43); and a turning handle (42) for operation of the adjusting element (36), the turning handle (42) being connected to the adjusting element (36) and rotatable about a turning-handle axis of rotation (44);

wherein the turning handle (42) is connected to the adjusting element (36) via a coupling element (39, 40, 18; 39, 40, 64) for translation of the operating motion of rotation into an adjusting motion;

with the adjusting-element axis of rotation (43) and the turning-handle axis of rotation (44) not being in alignment, and wherein a conical gear wheel (39) of the bevel gear pair (39, 40) has an internal thread with which engages an external gear, complementary thereof, of another coupling component of the coupling element (39, 40, 18; 39, 40), in particular of the adjusting element (36).

2. A chair according to claim 1, wherein the coupling element (39, 40, 18; 39, 40) comprises a deviating gear (39, 40).

3. A chair according to claim 2, wherein the deviating gear (39, 40) is a bevel gear pair which is in particular spur toothed.

4. A chair according to claim 1, wherein the turning handle (42) is laterally extended out of the seat support part (6; 7).

5. A chair according to claim 1, wherein the adjusting element (36) is an adjusting screw.

* * * * *